US007172540B2

(12) United States Patent
Nguyen

(10) Patent No.: US 7,172,540 B2
(45) Date of Patent: Feb. 6, 2007

(54) PORTABLE ABDOMINAL EXERCISER

(76) Inventor: Hai Minh Nguyen, 2165 Maroel Dr., San Jose, CA (US) 95130

( * ) Notice: Subject to any disclaimer, the term of this patent is extended or adjusted under 35 U.S.C. 154(b) by 0 days.

(21) Appl. No.: 10/855,906

(22) Filed: May 27, 2004

(65) Prior Publication Data

US 2005/0266971 A1 Dec. 1, 2005

(51) Int. Cl.
*A63B 26/00* (2006.01)
*A63B 71/00* (2006.01)

(52) U.S. Cl. ..... 482/140; 482/91

(58) Field of Classification Search ..... 482/904, 482/142, 140; 5/690.411; D06/596; D21/662, D21/676, 686.69
See application file for complete search history.

(56) References Cited

U.S. PATENT DOCUMENTS 2,941,216 A * 6/1960 Carlson ..... 114/359
3,523,310 A * 8/1970 Shead ..... 5/651
4,378,939 A * 4/1983 Wild ..... 482/140
4,515,361 A * 5/1985 Melillo et al. ..... 482/140
4,611,805 A * 9/1986 Franklin et al. ..... 482/129
4,679,787 A 7/1987 Guilbault
4,679,788 A * 7/1987 Adler ..... 482/140
5,108,092 A * 4/1992 Hurst ..... 482/60
5,160,306 A * 11/1992 Lui ..... 482/140
5,207,628 A * 5/1993 Graham ..... 482/140
D355,458 S * 2/1995 Chen ..... D21/673
5,743,050 A * 4/1998 Shibata ..... 52/27
5,776,039 A 7/1998 Perez, Jr.
5,820,532 A * 10/1998 Oliver ..... 482/123
5,871,422 A * 2/1999 Elbogen ..... 482/40
5,957,819 A * 9/1999 Cortesi ..... 482/121
6,013,014 A * 1/2000 Hern ..... 482/121
6,110,081 A 8/2000 Barrett
6,306,067 B1 * 10/2001 Gizas ..... 482/102
6,368,260 B1 * 4/2002 Crews ..... 482/142
6,494,817 B2 * 12/2002 Lake ..... 482/93
6,689,026 B2 2/2004 Almada
6,767,314 B2 * 7/2004 Thompson ..... 482/96
6,890,289 B2 * 5/2005 Spinosa ..... 482/140
2002/0133878 A1 * 9/2002 O'Connell ..... 5/81.1 R

* cited by examiner

*Primary Examiner*—Lori Amerson
(74) *Attorney, Agent, or Firm*—Tran & Associates

(57) ABSTRACT

A portable exercise device is disclosed for use in abdominal strengthening and toning in conjunction with a supporting component. The supporting structure can be a bed frame and the supporting component is usually the bed frame's transverse bar. The portable exercise device can be operated while lying on the bed, and includes bonded members: a first end, a body, and a second end. The first end is designed to hook to the support structure. The second end is designed to be place on a floor and is linked by two bar members that hook the user's feet in place. The body is a bar built between the first and second ends to secure the device.

20 Claims, 3 Drawing Sheets

PORTABLE ABDOMINAL EXERCISER

BACKGROUND

The use of portable exercise equipment increases in demand as awareness of exercise for general health is well documented. Traditionally, exercise equipment is solely found in health clubs and fitness centers. However, as the public becomes more educated about exercise and general health, an individual can be just as capable of an independent routine exercise program. This new home training regimen has created a demand for effective exercise equipment that is versatile and affordable, easy to use, and requires minimal storage space.

A number of innovations for portable exercise equipments have been provided. Even though these innovations may be suitable for the specific individual purposes, they differ from the present invention, as follows.

In U.S. Pat. No. 6,712,742, titled Compact Abdominal Exercise Apparatus by Suiter, a compact portable abdominal exercise apparatus is disclosed with a first member that concentrically slides in a second member, and resistance is provided by elastic attached between the distal end of the first member and the distal end of the second member. Handles position the user in an ergonomically neutral position that requires a user to crunch straight downward for the first member to slide properly within the second member. The straight downward crunching motion requires flexion of the user's lower vertebra column, thereby isolating the abdominal muscles from the hip flexors and back muscles. Molded covers protect the user from moving parts associated with the connector assembly. The user can quickly change the elastic members.

In U.S. Pat. No. 5,820,532, titled "Portable arm and leg exerciser" by Oliver, a portable arm and leg exerciser is disclosed having a base with three holes that are spaced closely. An elastic device with two ends is intertwined through the three holes in such a way that the elastic device is not easily pulled through the three holes and the end exit on an opposite side of the base, yet allows for easy adjustment. A grip handle is securely attached to one end. A padded loop is securely attached to the other end. The elastic device functions as a variable opposing force to a user. The user places the base of the exercise device between the spring and mattress of a bed to secure it. Adjusting the length of the elastic member varies the resistance of the device.

In U.S. Pat. No. 5,468,205, titled Portable Door Mounted Exercise Apparatus, invented by Michael McFall and Paul Aagaard, an exercise apparatus is disclosed having a pair of pulley support units mounted on a door by straps that vertically encircle the door. The support units are interconnected by a series of elastic bands, such as bungee cords that run vertical paths between the support units. The ends of the bands or cords are wrapped around pulleys and terminated such that a handle may be attached to the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

In U.S. Pat. No. 5,417,636, titled Body Stretching and Exercise Mat System, invented by Suzanne Havens, a body exercising and stretching mat having a resilient surface is provided. The mat folds into several sections along a hinge line for easy storage. The mat has a plurality or stations arranged on the mat. One or more handles or grips may be selectively inserted into the stations. The user sits on the mat and reaches outwardly to grasp the handles to provide stability and to provide a progressive measure of exercise progress. The mat may also be used with a toe bar that is positionable to assist the user in doing other types of exercises such as sit-ups. Elastic bands may be attached to either the toe bar or at selected stations for additional stretching and exercising capability.

In U.S. Pat. No. 5,160,303, titled Elastic Resistance Exercise Device having Resistance Element Retaining Structure, invented by Alvin H. Smith, a compact and easily adjusted exercising device useful for exercising the upper arms, shoulders, calves or the like is described. The device has a base that may be supported on a desk, table or floor. A pair of uprights support an upper bar over which one or more rubber bands are placed. This bar is removable when it is desired to change the rubber bands. A hollow lower bar is held between the uprights and the one or more rubber bands pass over this bar. A handle-supporting bar is then slid through vertical slots in the uprights and through the center of the lower supporting bar. This provides a light, easily adjusted exercising device, which can be easily used by the busy executive or even by bedridden persons.

In U.S. Pat. No. 4,872,671, titled Exercise Device Providing Varied and Predetermined Resistance, invented by John R. Brandell, an exercising device includes a pair of elongated handles each having an end portion and a gripping portion, with the end portions having an attached rotatable spinner members, with resilient elastic bands attached thereto, and wound together to define a substantially unitary resilient link between the handles interconnects the spinner members and providing a force against the relative movement of the handles with respect to each other to provide an isokinetic exercise device.

SUMMARY

In one aspect, a portable exerciser for use in conjunction with furniture having a support member includes an exerciser body having a first end and a second end, the first end adapted to be hooked to the support member and the second end adapted to be placed on a floor; and a bar positioned between the first and second ends to secure a user during exercise.

Implementations of the above device may include one or more of the following. The first end is preferably constructed to be U-shaped or hook-shaped, and is adapted to hook some type of furniture support, preferably the transverse slat of a bed frame. The second end, designed to be place on the floor, has two bar members to clasp the user's feet for leverage. The two bar members are covered with a cover/pad/roller over the end to protect and provide comfort to the user's feet during exercise. The roller is designed to slide onto the second end and can be constructed from one of the following material: plastic, urethane and rubber. The body can be constructed from a material selected from one of the following: wood, wood composite, metal, metal alloy, plastic, plastic composite, rubber composite, fiberglass, epoxy, carbon-graphite, rope, nylon strap (i.e. car seat material) and elastic cord.

In another aspect, the device can be seen as a system for exercising, including furniture having a transverse support member; and a portable exerciser for use in conjunction with the furniture. The exerciser body has a first end and a second end, with the first end is adapted to be hooked to the transverse support member and the second end adapted to be placed on a floor. The bar is positioned between the first and second ends to secure a user during exercise.

In yet another aspect, a method for exercising includes hooking a portable exerciser to a support member under a furniture, the exerciser including an exerciser body having a first end and a second end, the first end adapted to be hooked to the transverse support member and the second end adapted to be placed on a floor; and a bar positioned between the first and second ends to secure a user during exercise; securing feet to the bar; and exercising abdominal muscles using the portable exerciser.

Implementations of the above method may include one or more of the following. The user can slide a roller into each end of the bar. The user needs to just stow, or slide, the portable exerciser underneath the bed for storage. The furniture can be a bed frame and the support member can be a transverse bar. The user can lie on the bed and use the portable exercise device for resistance training. The user can perform crunching exercises on the abdominal muscles such as upper and lower rectus abdominus, the internal and external abdominal obliques or the transverse abdominus. The user can also exercise the user's stomach, back, neck, quadriceps and calves.

Advantages of the portable exerciser may include one or more of the following. The exercise equipment works the user's abdominal and surrounding muscles. The exercise equipment works in conjunction with a comfortable surface such as a bed or mattress surface to allow the user to comfortably achieve abdominal fitness. The exercise equipment does not require any type of mechanical connection between the device and the independent furniture from which the device is operated. The exercise equipment is suitable for physical therapy as well as gym use. The exercise device is simple, easily installed, versatile, portable, compact, and provides variable height adjustments depending on the height of furniture the device is connected. It also alleviates pre-assembly of the device before each use to connect to said furniture, thereby enabling the invention to be used with considerably less effort than conventional exercise devices.

The portable device can be bundled with mattress and furniture products to consumers as a package for sleep and exercise purposes. The exercise device can be sized to easily fit inside a traveling luggage. The exerciser is simple, easily installed, versatile, portable, compact, and provides variable height adjustments depending on the height of furniture that the device is connected to.

For a fuller understanding of the nature and objects of the invention, reference should be made to the following detailed description taken in connection with the accompanying drawings, which illustrate, by way of example, the principles of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION

Figure 1:
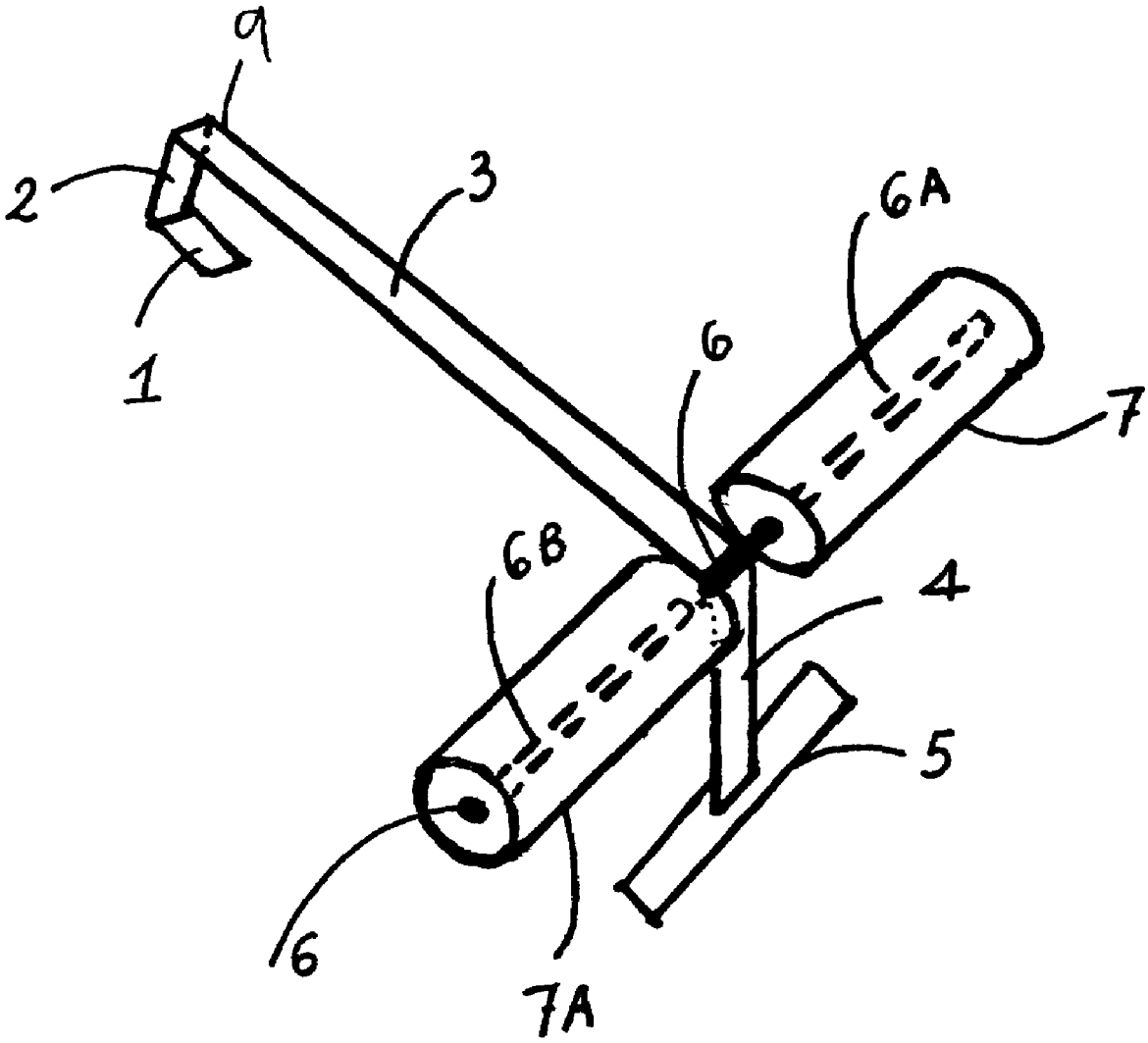
FIG. 1 is a perspective view of a portable exerciser.

Referring now to the drawings in greater detail, there are illustrated structural diagrams of the portable exercise device and its standard usage with a support structure, such as bed furniture. It will be understood that the user would maneuver one end of the portable exercise equipment to the bottom of the furniture and hook it over a horizontal bar or slat on the bed, as seen from a study of the diagrams.

FIG. 1 shows a visual diagram of the exercise device. The device includes an elongated bar (3), or body, connected to the first end (9) and the second end (5). The first end (9) is designed U-shaped formed with sides (1) and (2), and is to be hooked to a support structure. The second end (5) is adapted to be place on the floor and a bar (6) attached would be constructed over the second end (5) to secure the user's feet.

The bar members (6*a*–6*b*) act as foot support or handles, and the width of each bar member (6*a*–6*b*) should be wide enough to comfortably support the user's feet. Both members (6*a*–6*b*) are made of tubular configuration and are preferably cylindrical or pipe-shaped. It has a cross-section of a square, rectangular, pentagon, hexagon, or other geometric shapes. In this design, the size or diameter of each bar member (6*a*–6*b*) is slightly less than the size or diameter of the pad/covers/rollers (7*a*–7*b*), to enable the covers to slide over the each of the bar members (6*a*–6*b*).

The portable exercise equipment is ergonomically designed to be comfortable to a user. The bar members (6*a*–6*b*) facilitate the proper placement and securing of the user's feet during exercise. The bar covers/pads/rollers (7*a*–7*b*) reduces impact encountered during use of the exercise equipment, and should be composed of foam, or alternatively other soft materials such as plastic, rubber, urethane, or Styrofoam. The foam can be a flexible foam type material such as polyvinylchloride, urethane and olefinic polymers, such as polyethylene, among others. Alternatively, in place of the cover/pad/roller (7*a*–7*b*) on the members (6*a*–6*b*), padding can be mounted on the user's feet.

The body (3) and second end bar (6) and its bar members (6*a*–6*b*) can be composed of wood, wood composite, metal, metal alloy, plastic, plastic composite, rubber composite, fiberglass, epoxy, carbon-graphite, rope, nylon strap (i.e. car seat material) and elastic cords.

Figure 2:
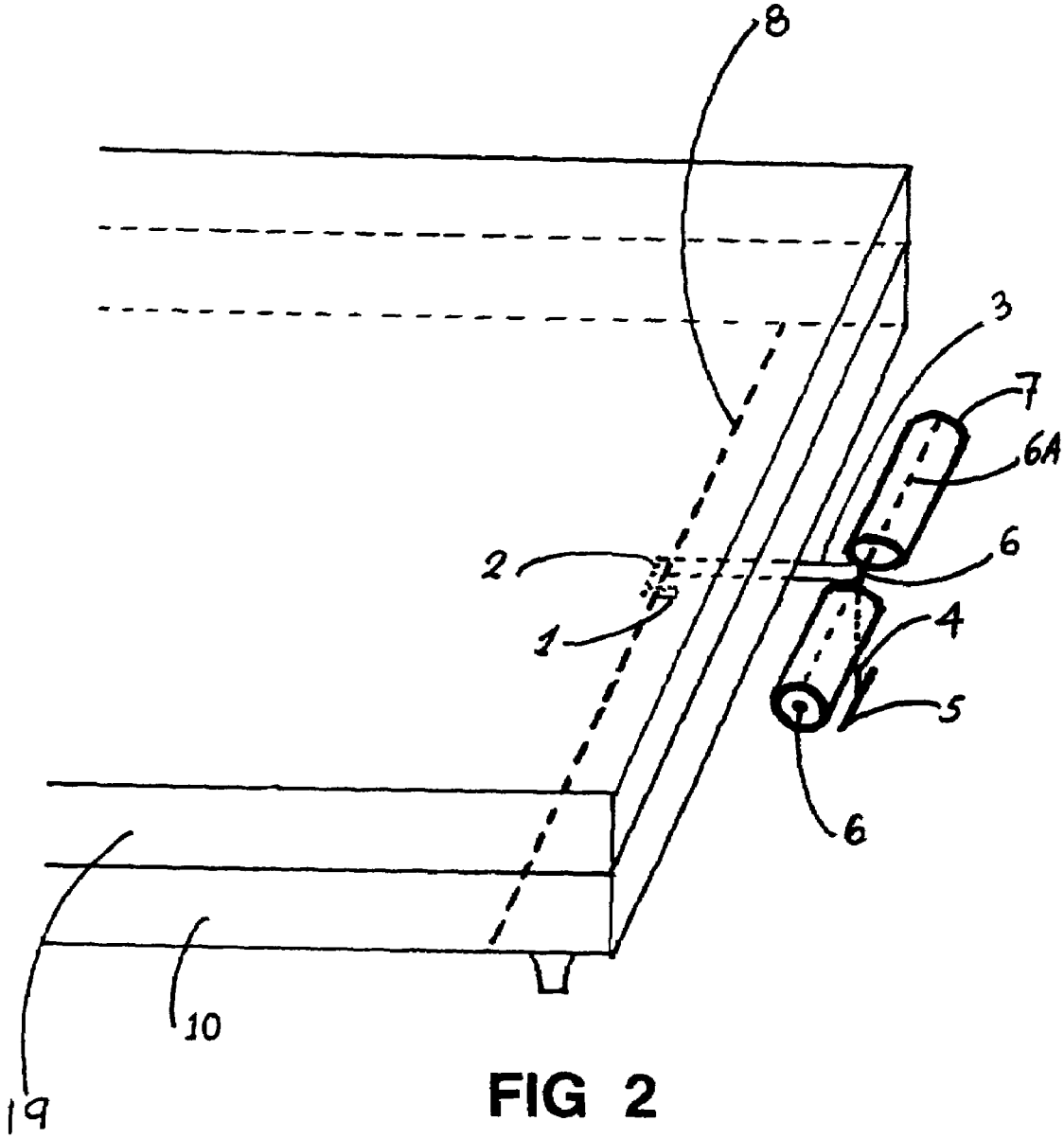
FIG. 2 is a perspective view of the portable exerciser connected to a support structure prior to exercise.

FIG. 2 illustrates a diagram where the portable exercise equipment is used in conjunction with a support structure (8)—in this case a bed. The device, designed to be used with a bed frame (10) and a mattress (19), with the bed usually with four legs that extend downwardly from the frame to engage with floor. The leg holds up the bed frame, the box springs and/or mattress (19), and any individual or individuals on the bed. The mattress can (19) include an ordinary mattress with support means such as a board or slats (8), a mattress (19) and box spring combination, or a separate box spring supporting an ordinary mattress (19).

The bed frame typically includes a pair of side rails connected by head and foot sections. Furthermore, such bed frame (10) structures typically include a series of transverse slats (that extend between the side rails and which supports a box spring or mattress. Before use, the portable exerciser is inserted underneath the bottom of the bed frame (10) and the first end (1–2) is hooked into one of the transverse slats. The second end (5) is positioned on the floor, with the bar members (6A–6B) positioned substantially parallel to the floor. The mattress (19) in effect becomes a comfortable exercise bench. To minimize potential discomfort to the user, the covers/pads/rollers (7*a*–7*b*) are inserted over the bar members (6*a*–6*b*). The user then slides his or her feet to be in contact with the floor and the rollers (7*a*–7*b*).

Figure 3:
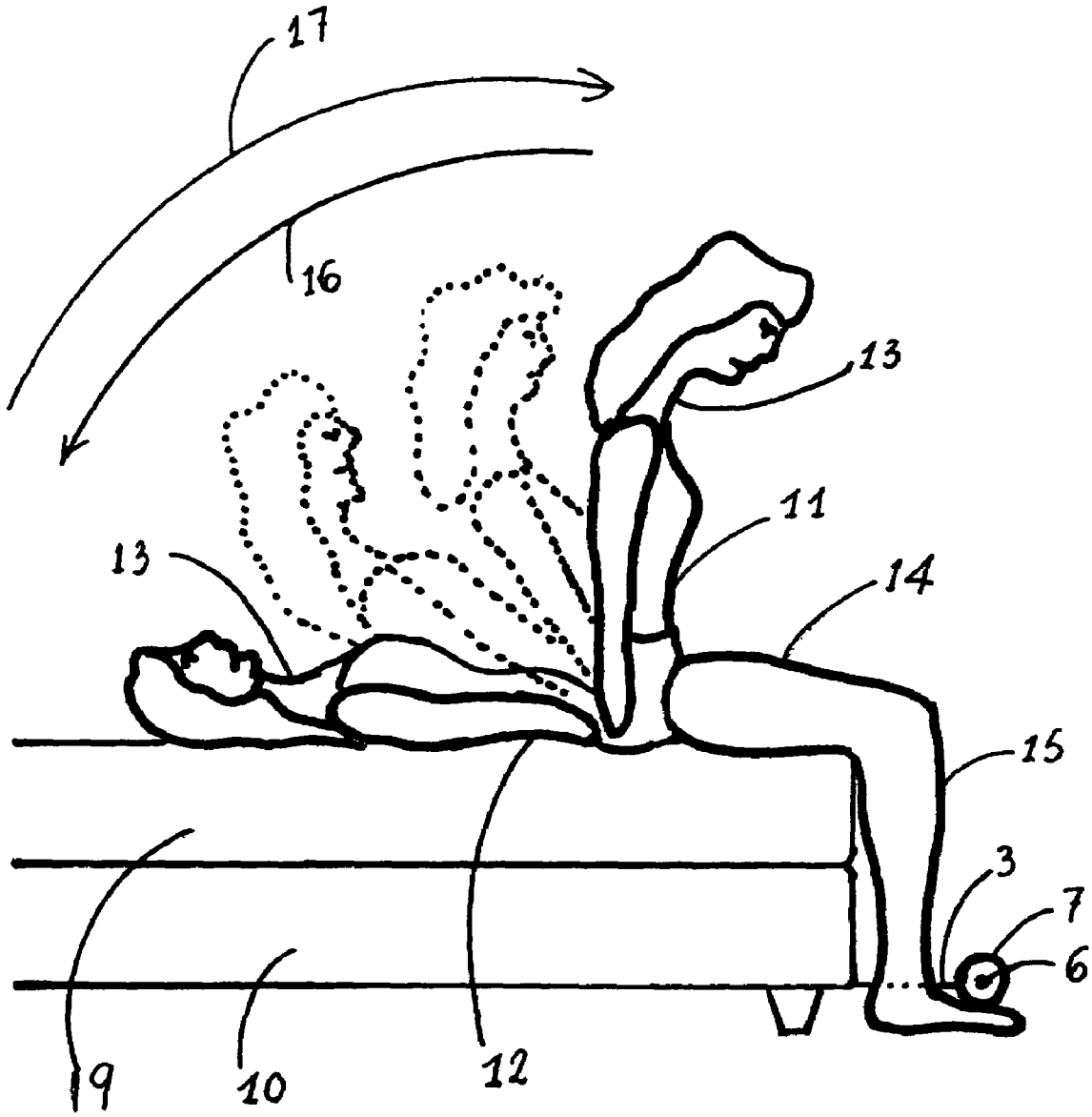
FIG. 3 is a perspective view of a portable arm and leg exerciser showing operation of the exerciser.

The portable exerciser can be used in a supine position, as depicted in FIG. 3. In the supine position, the user lies flat on his/her back with legs bent and with the feet either flat on the floor or with toes touching the floor. An upward crunching motion (17) is performed by the user and a subsequent downward crunching motion (16) is contrasted. The user overcomes the gravitational resistance of the user's upper body during the upwardly and downwardly crunching motions. When the user sits-up, the crunching motion provides resistance training of all of the abdominal muscles, including the upper and lower rectus abdominus, the internal and external abdominal obliques and the transverse abdominus. The portable exerciser also exercises the stomach (11), the back (12), the neck (13), the quadriceps (14) and the calves (15).

Although a bed has been mentioned as providing support for the portable exerciser, other furniture can be used. For example, sofa-sleeper can be used. Basically, a sofa-sleeper includes a foldable bed frame that supports a mattress. The sofa-sleeper is adapted for use as a sofa when the bed frame is folded up into a storage unit within the sofa framework to permit use of the structure as a seating surface. The sofa-sleeper also can be used as a bed when the bed frame is extended from the storage attitude into a generally horizontal bed attitude to permit use of the structure as a sleeping surface. Alternatively, a chair with a reinforcement bar spanning left and right sides of the chair can be used.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with granularity and detail in connection with what is presently deemed to be the invention, it will be apparent to those of ordinary skill that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A portable exerciser for use in conjunction with furniture having a support member, comprising:

an exerciser body having a first end and a second end, the first end being U-shaped and adapted to be hooked to the support member positioned above the second end and the second end adapted to be placed on a floor; and a bar positioned between the first and second ends to secure a user's feet during exercise, wherein the user lies substantially above the first and second ends.

2. The exerciser of claim 1 further comprising of a roller having an opening to slide or engage into one end of the bar.

3. The exerciser of claim 2, wherein the bar comprises a cross-section having one of cylindrical, pipe-shaped, square, rectangular, pentagon, and hexagon shape.

4. The exerciser of claim 1, further comprising two rollers to slide through both ends of the bar.

5. The exerciser of claim 4, wherein one of the rollers comprises one of the following: foam, plastic, rubber, urethane, and Styrofoam.

6. The exerciser of claim 1, wherein the bar and the body is constructed from a material selected from one of the following: wood, wood composite, metal, metal alloy, plastic, plastic composite, rubber composite, fiberglass, epoxy, carbon-graphite, rope, nylon strap and elastic cord.

7. The exerciser of claim 1, wherein the furniture is a bed frame and the support member is a transverse bar.

8. The exerciser of claim 7, further comprising a mattress positioned over the bed frame.

9. The exerciser of claim 1, wherein the furniture comprises a sofa-sleeper with a foldable bed frame to support a mattress.

10. The exerciser of claim 2, wherein the roller comprises one of the following: plastic, urethane and rubber.

11. The exerciser of claim 1, wherein the user provides resistance training.

12. The exerciser of claim 1, wherein the user trains one of abdominal muscles, including the upper and lower rectus abdominus, the internal and external abdominal obliques and the transverse abdominus.

13. The exerciser of claim 1, wherein the user trains the user's stomach, back, neck, quadriceps and calves.

14. A system for exercising, comprising:

a furniture having a transverse support member elevated above a floor;

and a portable exerciser for use in conjunction with the furniture, including:

an exerciser body having a first end and a second end, the first end adapted to be hooked to the transverse support member and the second end adapted to be placed on the floor; and a bar positioned between the first and second ends to secure a user during exercise.

15. The system of claim 14, wherein the first end is U-shaped.

16. The system of claim 14, further comprising of a roller having an opening to slide or engage into one end of the bar.

17. The system of claim 16, wherein the roller comprises one of the following: plastic, urethane and rubber.

18. The system of claim 14, wherein the body and the bar is constructed from a material selected from one of the following: wood, wood composite, metal, metal alloy, plastic, plastic composite, rubber composite, fiberglass, epoxy, carbon-graphite, rope, nylon strap (i.e. car seat material) and elastic cords.

19. A method for exercise, comprising of:

hooking a portable exerciser to a support member elevated above a floor under a furniture, the exerciser including an exerciser body having a first end and a second end, the first end adapted to be hooked to the transverse support member and the second end adapted to be placed on the floor; and a bar positioned between the first and second ends to secure a user's feet during exercise, wherein the user lies substantially above the first and second ends;

securing a user's feet to the bar while lying on the furniture;

performing sit-ups above the furniture to exercise abdominal muscles using the portable exerciser; and after use, stowing the portable exerciser by sliding the portable exerciser under the furniture.

20. The method of claim 19, wherein the user trains one of: stomach, back, neck, quadriceps, calves.

* * * * *